US005718851A

United States Patent [19]

Wadas, Jr.

[11] Patent Number: 5,718,851

[45] Date of Patent: Feb. 17, 1998

[54] PILE CAP ASSEMBLY AND METHOD

[76] Inventor: Ronald M. Wadas, Jr., 1424 Collins Rd., Ft. Myers, Fla. 33919

[21] Appl. No.: 636,160

[22] Filed: Apr. 22, 1996

[51] Int. Cl.[6] ..... E04B 1/16

[52] U.S. Cl. ..... 264/32; 405/255; 405/257

[58] Field of Search ..... 52/301, 300, 309.8, 52/244, 309.1; 405/255, 257; 264/32

[56] References Cited

U.S. PATENT DOCUMENTS

| | | | |
|---|---|---|---|
| 1,039,085 | 9/1912 | Blumer . | |
| 1,088,060 | 2/1914 | Carter . | |
| 3,250,050 | 5/1966 | Finger et al. . | |
| 3,319,332 | 5/1967 | Finger et al. . | |
| 3,448,585 | 6/1969 | Vogelsang . | |
| 4,019,301 | 4/1977 | Fox . | |
| 4,161,090 | 7/1979 | Watts, Jr. . | |
| 4,245,931 | 1/1981 | Watts, Jr. | 52/301 |
| 4,892,410 | 1/1990 | Snow et al. . | |
| 4,983,072 | 1/1991 | Bell, Jr. . | |
| 5,487,618 | 1/1996 | Cox . | |

FOREIGN PATENT DOCUMENTS

| | | |
|---|---|---|
| 1-290820 | 11/1989 | Japan . |

*Primary Examiner*—Carl D. Friedman
*Assistant Examiner*—Creighton Smith
*Attorney, Agent, or Firm*—Laura G. Barrow

[57] ABSTRACT

An improved protective pile cap formed of a polymeric compound and a binder and a method of assembling the cap onto the top of a pile is described, wherein the cap is particularly durable and provides for excellent protection of the open grain of the top end of a pile to prevent deterioration of the pile due to exposure from various environmental elements.

12 Claims, 6 Drawing Sheets

PILE CAP ASSEMBLY AND METHOD

BACKGROUND OF INVENTION

1. Field of Invention

The present invention relates to an improved protective pile cap assembly and method for securing a protective cap to the end of a pile.

2. Background of Invention

Wooden posts and pilings deteriorate in use from exposure to various environmental factors such as heat, direct sun exposure, water, bacteria, fungi, and insects. Pilings used in various marine applications, such as piers and decks, are particularly susceptible to this deterioration due to moisture permeating the pile, including the end of the pile, which in combination with the direct sunlight and heat can cause the pile to rot more quickly. Pilings used in ocean water are even more susceptible to corrosion due to the high salinity content. When a post or pile does deteriorate, the structural integrity is compromised, therefore requiring replacement of all or part of the pile, which can be a very difficult and expensive venture.

There exist various methods for encapsulating all or part of a pile used in marine applications, such as those described in U.S. Pat. No. 4,892,410 to Snow et al., for example. However, while it may be desireable to encapsulate all or part of the sides of a pile, in its particularly important in marine applications to enclose the top of the pile with a protective cap. This is due in large part to the greater susceptibility or ability of water to penetrate the pile from the top, versus the sides of the pile, and migrate downward and outward throughout the pile to cause rotting therein.

Currently there exist various types of protective caps for all types of piles or posts, including aluminum caps, copper caps, and caps formed of plastic, such as polyvinylchloride (PVC). Other types of materials for use as pole caps include an elastomeric material (U.S. Pat. No. 3,250,050; U.S. Pat. No. 3,319,332) and heat-shrinkable plastic (U.S. Pat. No. 3,448,585). Other types of caps are those disclosed U.S. Pat. No. 4,161,090 to Watts, Jr. and include a galvanized metal cap, an asphalt covering and a metal cap screwed to the top of the post, and a steel or copper cover with screws in a flange covering a felt pad over the end of a post.

The cap described in Watts, Jr. is a two-component system comprising an outer preformed plastic cap and an inner adhesive foam cushion formed of polyurethane, for example. The assembly process comprises introducing mixed chemicals capable of foaming inside the outer plastic cap, rocking the cap to distribute the chemicals throughout the surface of the cap, and then placing the cap on the end of the post while the chemicals foam. The foam lining is semi-rigid, and serves as an adhesive to adhere the cap to the post and to prevent moisture from entering the post.

Another type of cap assembly disclosed in Watts, Jr. comprises the use of a fiber glass cloth impregnated with a slow cure resin that is layered upon, and formed to, the end of the post or piling. As correctly noted in Watts, Jr., this type of cap is disadvantageous in that the covering tends to pull away during the cure and leaves voids between the post or piling end and the covering cloth. In addition, when unsupported and being somewhat brittle, it tends to crack or be otherwise damaged from impact.

II. SUMMARY OF THE INVENTION

The present invention is directed to an improved protective cap for piles or posts that is extremely durable, is permanent, and functions as a barrier to moisture, direct sunlight, and other environmental factors that directly cause deterioration of the pile. The present invention is particularly effective in protecting the open grain at the top of the pile from water, which causes the pile to rot, split, and chip. Specifically, the present invention is directed to a pile assembly comprising the protective cap as well as a method of securing the protective cap to the pile. In one embodiment the inventive method comprises the steps of:

(A) securing a jacket about the sides of the pile, said pile having a top end for receiving a cap, wherein said jacket comprises a bottom end secured to the sides of said pile to form a seal and an outer casing adjacent said bottom end and positioned a distance from said pile to form a void between said casing and said pile sides, said outer casing further extending a distance above said top end of said pile;

(B) pouring a capping composition onto the top end of the pile to fill the void between the outer casing and pile and to cover the top end of the pile, wherein said composition comprises a polymeric compound and a binder and is effective in securing said cap to said pile; and (C) removing said jacket from said pile after said capping composition has hardened to form a cap adhered to the pile.

Alternatively, the jacket can be secured to the sides of the pile without forming a void therebetween, such that the capping composition is applied only to the top end of the pile, thereby resulting in a protective cap having only a top portion and no adjacent skirt portion.

Preferable polymeric compounds include conventional fiberglass resins, including polyester resins, epoxy resins, and vinyl ester compositions, for example; however, any polymeric compound capable of curing within a set period of time may be employed. The capping composition preferably includes an accelerating agent, such as methylethylketone peroxide, which is employed to initiate the curing process. The capping composition further includes a binder, most preferably sand or chipped cloth, to impart strength to the cap. Alternatively, the inventive method further comprises the step of applying a fabric sheet, preferably one formed of fiberglass, onto the top end of the pile after the capping composition has been poured, but prior to hardening, for incorporation therein. Incorporation of the fabric sheet into the capping composition is preferable in that it helps prevent the finished cap from cracking. Once the capping composition, and optionally the fabric sheet, have been applied to the pile, the jacket is removed to provide an extremely secure and durable cap resistant to moisture, ultraviolet radiation, fungi, bacteria, insects, wind erosion, as well as chipping or splitting.

III. BRIEF DESCRIPTION OF THE FIGURES

IV. DETAILED DESCRIPTION OF THE PREFERRED EMBODIMENTS

Figure 1:
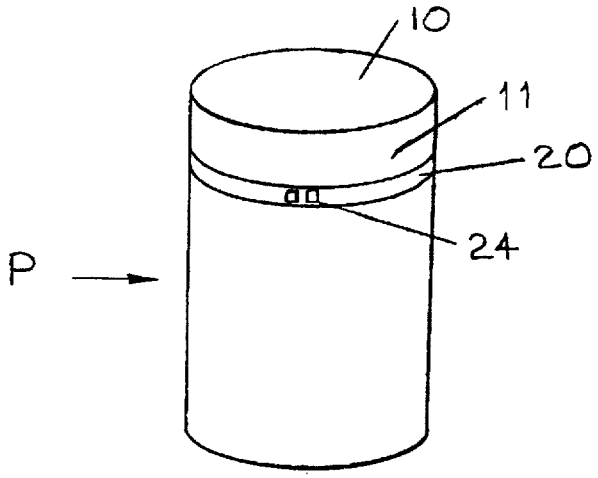
FIGS. 1–4 illustrate the preferred steps involved in applying one embodiment of the inventive cap to the top of a pile.

The present invention is directed to an improved cap for protecting the top end of a pile or post from deteriorating as a result from exposure to various environmental elements. While the present invention is described with reference to piles and posts, which are used interchangeably herein and are illustrated in the figures as a longitudinal member, it is to be understood that the present invention is not so limited and that these terms further include any structure of any shape, cylindrical or rectangular, for example, for which it is desireable to have a protective cap affixed thereto.

For ease of explanation, the present invention will be described below in two sections. Section I will address the composition of the cap and Section II will address preferred methods of applying the cap to a pile.

I. Capping Composition

The inventive cap (C) is formed of a durable material that is particularly resistant to cracking and splitting. When affixed to the top end (10) of a pile (P), the cap (C) protects the pile from rotting and deterioration resulting from exposure to various environmental elements, including but not limited to, direct sunlight and heat, moisture, fungi, bacteria, insects, and wind. The cap (C) is particularly useful for piles used in marine applications, such as piers and decks, for example, where the high salinity of the water is particularly corrosive to the pile, especially a wooden pile.

The preferred capping composition of the present invention comprises a polymeric compound, most preferably of the type used as conventional fiberglass resins, such as epoxy, polyester, and vinyl ester resins. As commonly known by the those of ordinary skill in the art, typical polyester resins often include an additional reactive diluent, such as a styrene monomer or other cross-linking agent. Moreover, typical epoxy resins often include two components: a polymeric compound and a hardener. Exemplary commercial products include POLYLITE Polyester Resin (polyester resin and styrene monomer) and EPOTURF (epoxy resin and aklyglycidyl ether), both manufactured by Reichhold Chemicals, Inc. of Durham, N.C. The most preferred polymeric compound is POLYLITE. While the foregoing polymeric compounds are preferred, any conventional polymeric compound, including those typically used in various fiberglass applications, that are capable of curing or hardening after a period of time, may be used. Such compounds, upon hardening, provide a durable cap that is securely fixed to the pile for permanent attachment.

For the preferred polymeric compound products discussed above, the addition of a catalyst (i.e. accelerating agent) to the resin is required to initiate the curing process. A preferred catalyst is methylethylketone (MEK) peroxide SUPEROX by Reichhold Chemicals, Inc.). Preferably, the polymeric resin is prepared by adding 1 ounce of MEK peroxide to 1 gallon of resin.

In addition to the polymeric compound, the capping composition includes a binding agent. While typical binding agents such as fiberglass cloth, fiberglass mat roving, or chipped glass fabric may be used, the most preferred binding agent is silica sand, most preferably sand of a medium to course grain size. [The combination of resin and sand, as opposed to other types of binders, is advantageous in that it allows the capping composition to flow better and fill evenly the void present between the jacket and pile, as discussed further in the Section II.] It is important that the sand be free from moisture, since it is believed that the presence of moisture in the sand may cause the top of the finished cap to crack after cure (i.e. upon hardening). As discussed in more detail in Section II, application of a fiberglass matt, for example, to the top of the pile after the application of the capping composition for incorporation therein can alleviate this problem.

In the most preferred embodiment, about one cup of sand is combined with about one quart of the polymeric compound, most preferably a polyester resin. The two components are combined with stirring to form a substantially homogenous capping composition suitable for application to the end of a pile, as discussed in more detail in Section II below. Optionally, a color tint may be added to the composition (preferably in a ratio of 1 ounce of tint to 1 gallon of capping composition).

II. Method of applying the cap

Figure 1A:
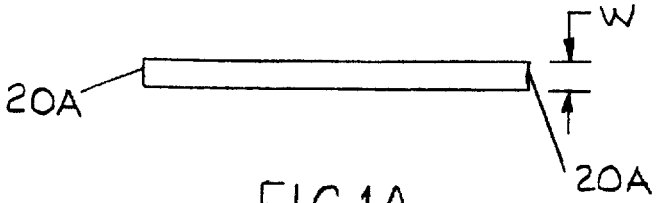
FIG. 1A is a strip used in the inventive method and serves as the bottom seal of the jacket assembly.

FIGS. 1–5 illustrate a preferred method for applying the inventive cap (C) onto the top end (10) of a pile (P). As mentioned previously, the pile (P) may be of any size or shape. Prior to assembling the jacket to the pile, the pile should be wiped off to remove any debris and dirt, although extensive cleaning or degreasing is not necessary. Also, if the portion of the pile to which the cap is to be applied is wet, that portion should be dried prior to applying the cap. In the latter case, the specific portion of the pile may be covered and allowed to air-dry naturally. Next, a jacket or jacket assembly is attached to the pile to receive the capping composition (30) and comprises a bottom end (20), an outer casing (21), and various means for securing the foregoing jacket to the pile (P). It is to be understood, however, that any jacket or jacket assembly suitable as a mold for receiving the capping composition may be employed in the present invention. As shown in FIG. 1, the pile (P) is prepared by first applying a strip of material (20), preferably an elastomeric material such as rubber, around the sides (11) of the pile (P) to serve as the bottom end of the jacket, as discussed below. Preferably, the strip has a thickness (T) of at least 0.25 inches and a width (W) of from about 1.0 to about 1.5 inches, most preferably 1.0 inch (see FIGS. 1A–1B). It is important that the two ends (20A) of the strip not overlap. The ends (20A) of the strip may be secured by any suitable means, preferably ½ inch wire brads (24). The strip (20) functions as a seal to prevent the capping composition (30) from leaking out of the jacket assembly.

Figure 2:
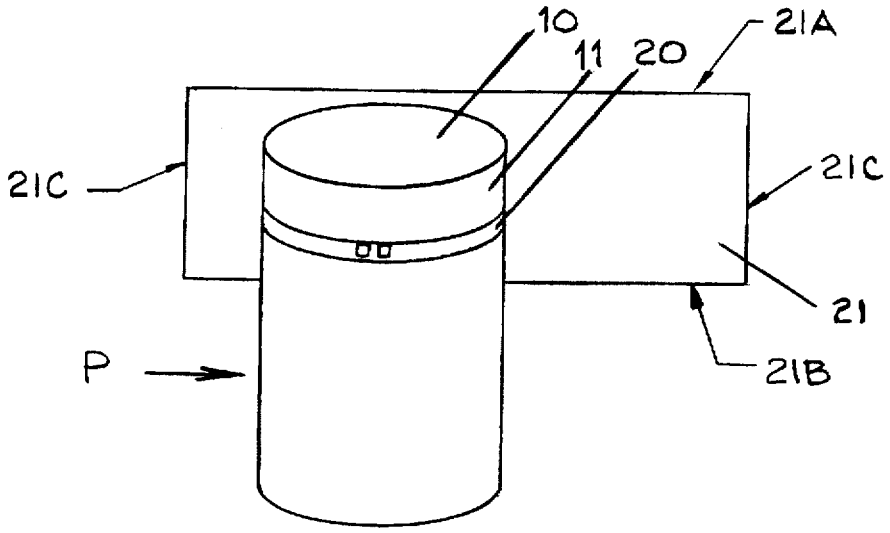

Next, an outer casing (21), preferably a sheet of flashing formed of a malleable metal such as aluminum, for example, is wrapped around the upper end of the pile and strip as shown in FIG. 2. It is most preferable that the casing (21) be of sufficient size such that when secured to the pile (P), the top edge (21A) of the casing is positioned about ¼ inch from the top end (10) of the pile, and the lower edge (21B) of the casing is positioned about 1 inch below the strip (20). The casing (21) should also be long enough such that there exists about a one-inch overlap of its ends (21C) when it is wrapped around the pile. Notwithstanding the foregoing, it is understood that one of ordinary skill in the art would be capable of modifying the dimensions of the casing and strip, for example, to adjust for different size caps, if desired.

Figure 3:
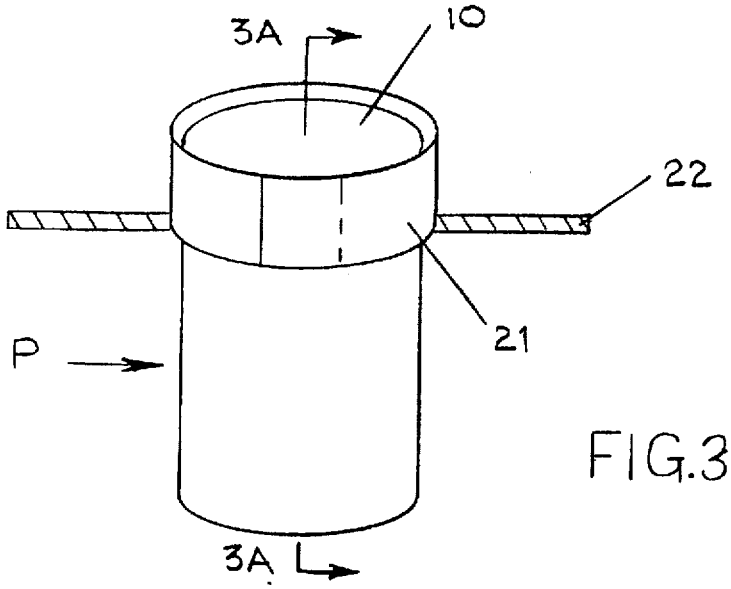

Next, the outer casing (21) is secured in place, preferably by a threaded clamp (22) or other suitable means, as shown in FIG. 3. The preferred finished jacket thus comprises the outer casing (21) spaced apart from the pile (P) by the strip

Figure 3A:
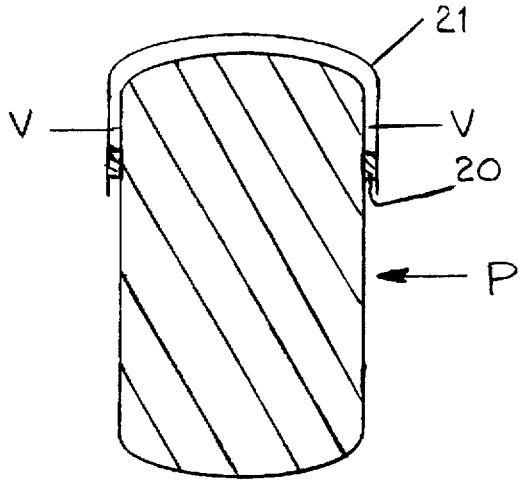
FIG. 3A is a cross-sectional view of the pile taken along lines 3A—3A of FIG. 3.
Figure 1B:
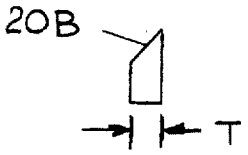
FIG. 1B is a side view of the strip taken along lines 1B—1B of FIG. 1A.
Figure 6:
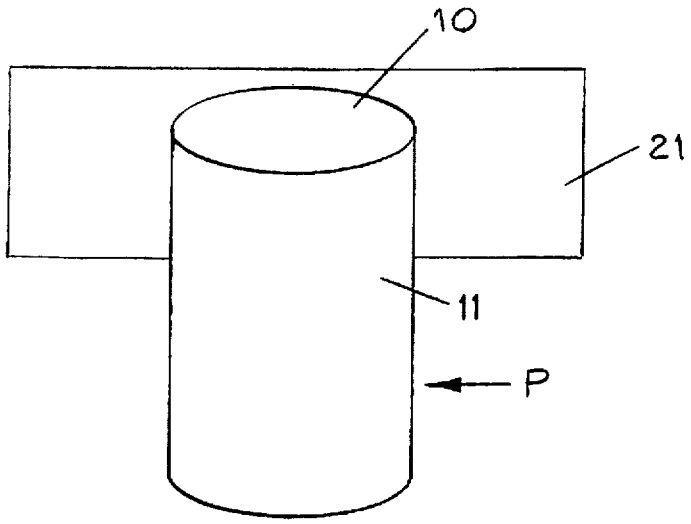
FIGS. 6–8 illustrate the preferred steps involved in applying a second embodiment of the inventive cap to the top of a pile.
Figure 7:
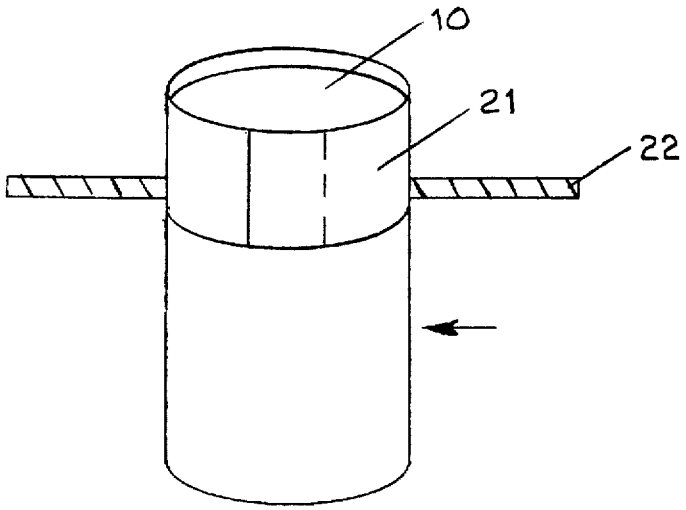
Figure 8:
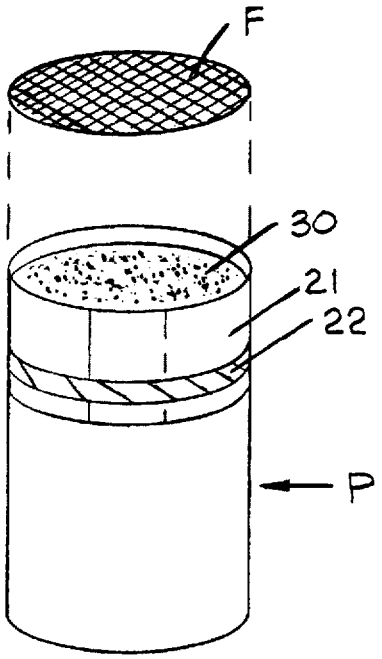

(20) to allow for the capping composition (30) to be applied to the sides (11) as well as the top end (10) of the pile (P). As discussed above, the strip (20) serves as a seal to prevent the capping composition (30) from leaking out of the jacket. The strip (20) also defines the size of the void (V)—i.e. the distance between the casing (21) and the sides (11) of the pile (see FIG. 3A, for example). It is 5 also preferable that the strip (20) have an angled top edge (20B), as shown in FIG. 1B, to give the finished cap (C) a smooth edge upon removal of the jacket assembly.

Figure 4:
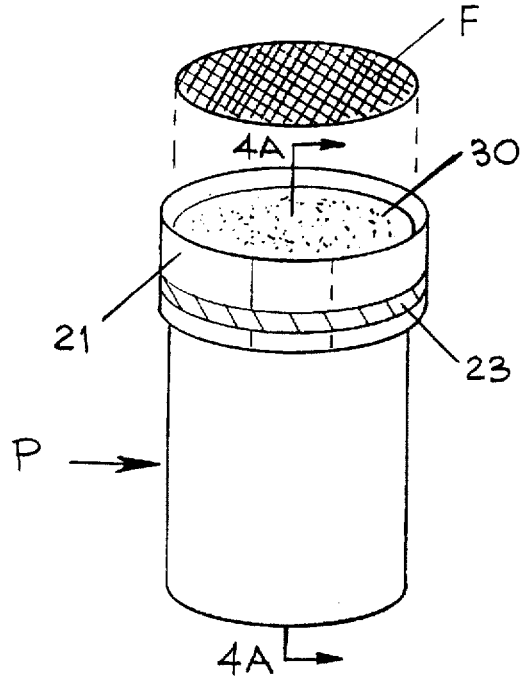
Figure 4A:
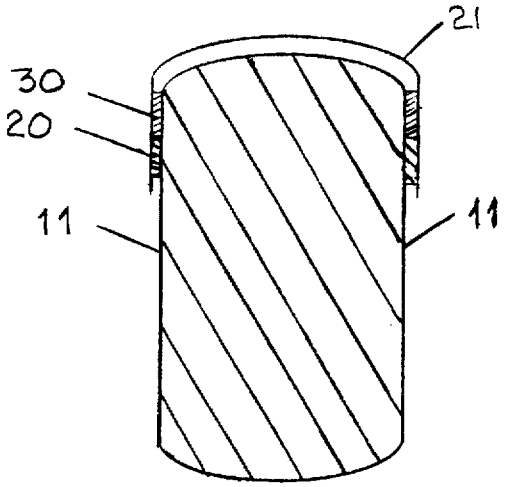
FIG. 4A is a cross-sectional view taken along lines 4A—4A of FIG. 4.

After the jacket has been secured to the pile as discussed above, the capping composition (30) described in Section I is then poured into the jacket to cover the entire top end (10) of the pile and fill the void (V) between the casing (21) and the sides (11) of the pile, as shown in FIGS. 4 and 4A. As the capping composition (30) is being poured into the jacket, the jacket (e.g. casing) should be tapped or vibrated to ensure an adequate fill (i.e. that the composition completely and evenly fills the void (V)).

After the capping composition (30) has been poured into the jacket, a fabric sheet (F) is then placed on top of the pile and the capping composition (30), as shown in FIG. 4. Once the capping composition (30) hardens, the fabric sheet (F) is incorporated into the capping composition (30) to provide for a more durable cap that is particularly resistant to cracking upon hardening (i.e. after cure). A preferred type of fabric sheet is a fiberglass matt, although other types of fiberglass materials, such as cloth and wroven may be employed. As discussed above, it is believed that the presence of moisture in the binding agent, in particular sand, may cause cracking after cure, such that is it is preferable that such a fabric sheet be used in combination with the capping composition to prevent this occurrence.

Figure 5:
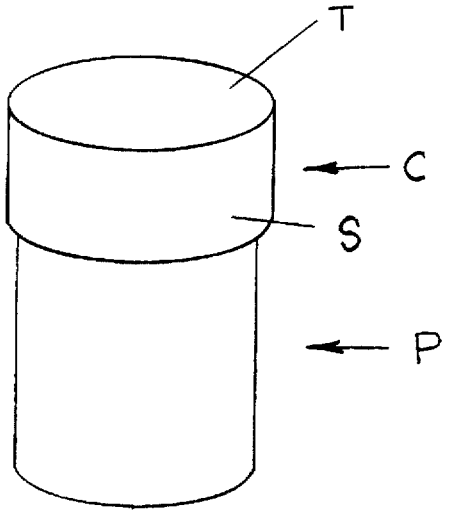
FIG. 5 is an elevated view of the first embodiment of the finished pile/cap assembly constructed as shown in FIGS. 1—4.

After the capping composition (preferably in combination with the fabric sheet) has cured (i.e. from about 2 to about 3 hours) the jacket (i.e. casing, strip, and any fastening means) may be removed. The finished cap (C), as illustrated in FIG. 5 comprising a top portion (T) and a skirt portion (S), not only provides for excellent protection of the open grain of the top end (10) of the pile, but is also permanently affixed to the pile and thus cannot be easily removed. Consequently, the cap does not require any additional means of mechanical fixation, such as bolts or nails, which not only are aesthetically unpleasing, but can compromise the integrity of the underlying pile as well as diminish the protective ability of the cap itself.

Figure 9:
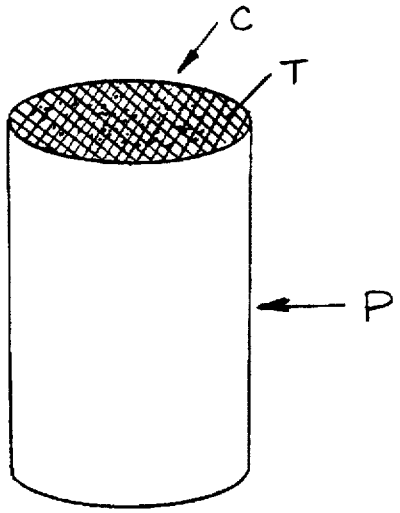
FIG. 9 is an elevated view of the second embodiment of the finished pile/cap assembly constructed as shown in FIGS. 6–8.

FIGS. 6–9 illustrate another embodiment of the present invention, wherein the outer casing (21) is secured directly to the sides (11) of the pile (i.e. it is flush with the pile) without the use of a separate strip or bottom seal, thereby eliminating any void between the sides (11) of the pile and the casing (21). Thus, when the capping composition (30) is poured into the jacket, only the top end (10) of the pile is covered with the capping composition (30), such that the finished cap (C) as shown in FIG. 9 comprises only a top portion (T) and no skirt portion. The first embodiment of the inventive cap comprising a skirt (S) is more preferred, however, since it is much less susceptible to being removed, and thus is more permanent than the latter embodiment without a skirt. The latter embodiment, however, may in some instances be more preferred when it is desirable to remove the cap or when the upper sides of the pile must be exposed.

The finished cap (C) may be subsequently painted or have other devices, such as lights or signs, for example, attached to it. The device may either be attached by mechanical means to the cap after the capping composition has been allowed to cure, or just prior to hardening, such that the device is affixed or adhered to the cap by the capping composition itself upon subsequent hardening.

The foregoing disclosure and description of the invention are illustrative and explanatory thereof, and various changes in the size, shape, and materials, as well as in the details of the illustrated construction may be made without departing from the spirit of the invention, and therefore fall within the scope of the appended claims even though such variations were not specifically discussed above.

I claim:

1. A method of securing a cap to a pile comprising the steps of:

(A) securing a jacket to a pile, said pile having a side portion and a top end integral with said side portion, and wherein said jacket comprises a bottom end secured to the side portion of said pile and an outer casing adjacent said bottom end and positioned a distance from said pile to form a void between said casing and said pile side portion;

(B) pouring a capping composition onto the top end of the pile to fill said void and to cover the top end of the pile, wherein said composition comprises a polymeric compound and a binder and is effective in securing said cap to said pile; and (C) removing said jacket from said pile after said capping composition has hardened to form a cap adhered to said pile.

2. The method of claim 1, wherein said binder comprises sand.

3. The method of claim 1, wherein said polymeric compound is selected from the group consisting of polyester, epoxy, and vinyl ester compounds.

4. The method of claim 1, wherein after step (B), further comprising the step of applying a fabric sheet onto said top end of said pile.

5. The method of claim 4, wherein said binder comprises sand.

6. The method of claim 4, wherein said fabric sheet comprises fiberglass.

7. A method of securing a cap to a pile comprising the steps of:

(A) securing a jacket to a pile, said pile having a side portion to which said jacket is secured and a top end, wherein said jacket extends a distance above said top end of said pile;

(B) pouring a capping composition onto the top end of the pile to cover the top end of the pile, wherein said composition comprises a polymeric compound and a binder and is effective in securing said cap to said pile; and (C) removing said jacket from said pile after said capping composition has hardened to form a cap adhered to said pile.

8. The method of claim 7, wherein said binder comprises sand.

9. The method of claim 7, wherein said polymeric compound is selected from the group consisting of polyester, epoxy, and vinyl ester compounds.

10. The method of claim 7, wherein after step (B), further comprising the step of applying a fabric sheet onto said top end of said pile.

11. The method of claim 10, wherein said binder comprises sand.

12. The method of claim 10, wherein said fabric sheet comprises fiberglass.

* * * * *